US006546765B1

(12) United States Patent
Linares

(10) Patent No.: US 6,546,765 B1
(45) Date of Patent: Apr. 15, 2003

(54) L-HANDLE WITH SAFETY LOCK FEATURE

(75) Inventor: Rodolfo A. Linares, Whittier, CA (US)

(73) Assignee: S.P.E.P. Acquisition Corporation, Rancho Dominguez, CA (US)

( * ) Notice: Subject to any disclaimer, the term of this patent is extended or adjusted under 35 U.S.C. 154(b) by 0 days.

(21) Appl. No.: 10/010,454

(22) Filed: Dec. 4, 2001

(51) Int. Cl.[7] ..... E05B 13/10; G05G 5/06

(52) U.S. Cl. ..... 70/210; 70/209; 70/215; 70/211; 70/216; 70/224; 292/285; 292/336.3; 292/347; 16/412; 16/414

(58) Field of Search ..... 70/209, 210, 211, 70/212, 215, 216, 224; 292/336.3, 347, 285, 286; 16/412, 414, 429

(56) References Cited

U.S. PATENT DOCUMENTS

| | | | | | |
|---|---|---|---|---|---|
| 2,254,007 | A | * | 8/1941 | Fletcher | 70/215 |
| 2,939,308 | A | * | 6/1960 | Trammell, Jr. | 70/210 |
| 4,036,039 | A | * | 7/1977 | Nakanishi | 70/90 |
| 4,484,462 | A | * | 11/1984 | Berkowitz | 70/368 |
| 4,991,414 | A | * | 2/1991 | Moore et al. | 70/215 |
| 5,408,853 | A | * | 4/1995 | Yamada | 70/210 |
| 5,634,357 | A | * | 6/1997 | Nutter et al. | 70/210 |
| 5,664,448 | A | * | 9/1997 | Swan et al. | 70/224 |
| 6,029,484 | A | * | 2/2000 | Jetton | 70/371 |
| 6,068,308 | A | * | 5/2000 | Molzer | 292/336.3 |
| 6,178,789 | B1 | * | 1/2001 | Finkelstein et al. | 70/210 |
| 6,318,770 | B1 | * | 11/2001 | Molzer | 292/336.3 |

FOREIGN PATENT DOCUMENTS

| | | | | | |
|---|---|---|---|---|---|
| DE | 3510439 | A1 | * | 9/1986 | E05B/13/10 |
| DE | 3840183 | A1 | * | 5/1990 | E05B/13/10 |
| EP | 0002381 | A1 | * | 6/1979 | E05C/13/02 |
| EP | 0403868 | A2 | * | 12/1990 | E05C/13/10 |
| GB | 2040344 | A1 | * | 8/1980 | E05C/13/02 |

* cited by examiner

*Primary Examiner*—Anthony Knight
*Assistant Examiner*—Christopher Boswell
(74) *Attorney, Agent, or Firm*—Christie, Parker & Hale, LLP

(57) ABSTRACT

A bellcore-style latch with a safety lock feature, having a handle with a shank. The shank has an axial bore, with side apertures extending through the shank into the bore. A lock plug is positioned in the bore of the handle, and has a head and a shaft. The shaft has recessed portions and unrecessed portions, and the lock plug is rotatable to move the lock plug between a locked position, wherein the unrecessed portions are in alignment with the side apertures to cause the ball bearings located therein to protrude from the side apertures, and an unlocked position, wherein the unrecessed portions are in alignment with the side apertures permitting the ball bearings to retract into the side apertures. A spring is used to bias the lock plug to its locked position. An escutcheon with an aperture is provided for receiving the shank portion. The aperture has pockets for the ball bearings. When the handle is in a closed position and the lock plug is in the locked position, the unrecessed portions of the shaft are aligned with the side apertures and the pockets and the ball bearings are protruded into the pockets, thereby preventing turning of the handle. When the lock plug is turned by a lock key to the unlocked position, the recessed portions of the shaft are aligned with the side apertures and the ball bearings can retract from the pockets, thereby permitting the handle to be turned and opened.

23 Claims, 11 Drawing Sheets

L-HANDLE WITH SAFETY LOCK FEATURE

BACKGROUND OF THE INVENTION

The invention relates to locking handles, and more particularly to a so-called bellcore style L-handle with a safety lock feature.

In certain applications using L-handle latches, it is desirable to have a self-locking feature that prevents the door handle from being inadvertently opened if the handle is bumped. These locking door handles typically have an escutcheon and a handle, with the escutcheon and handle having brackets formed thereon which brackets can be affixed together, for example, with a padlock to securely lock the handle in a locked position. However, in many of these designs, the handle can be readily opened when not padlocked to the escutcheon. It is desirable to include a safety lock feature which prevents the handle from being inadvertently turned from a locked position without use of a special tool, which feature will help prevent the handle from being inadvertently opened. There are other L-handle products that include a safety lock feature. In these other designs, the safety locks are on the escutcheon and have mechanisms which interact with a cam connected to the handle. These prior designs are susceptible to rough and unreliable operation. It is desirable to have a L-handle with the ball-bearing safety lock feature with the safety lock feature being accessible in the handle rather than in the escutcheon.

SUMMARY OF THE INVENTION

It is an object of the present invention to provide an improved L-handle with a safety lock feature.

It is another object of the invention to provide a L-handle with a safety lock feature having a ball-bearing safety lock mechanism to insure smooth and reliable operation.

It is yet a further object of the invention to provide a L-handle with safety lock feature, with a ball-bearing lock being positioned within a handle portion of the lock rather than on an escutcheon portion of the lock.

DETAILED DESCRIPTION OF AN EMBODIMENT OF THE INVENTION

Figure 1:
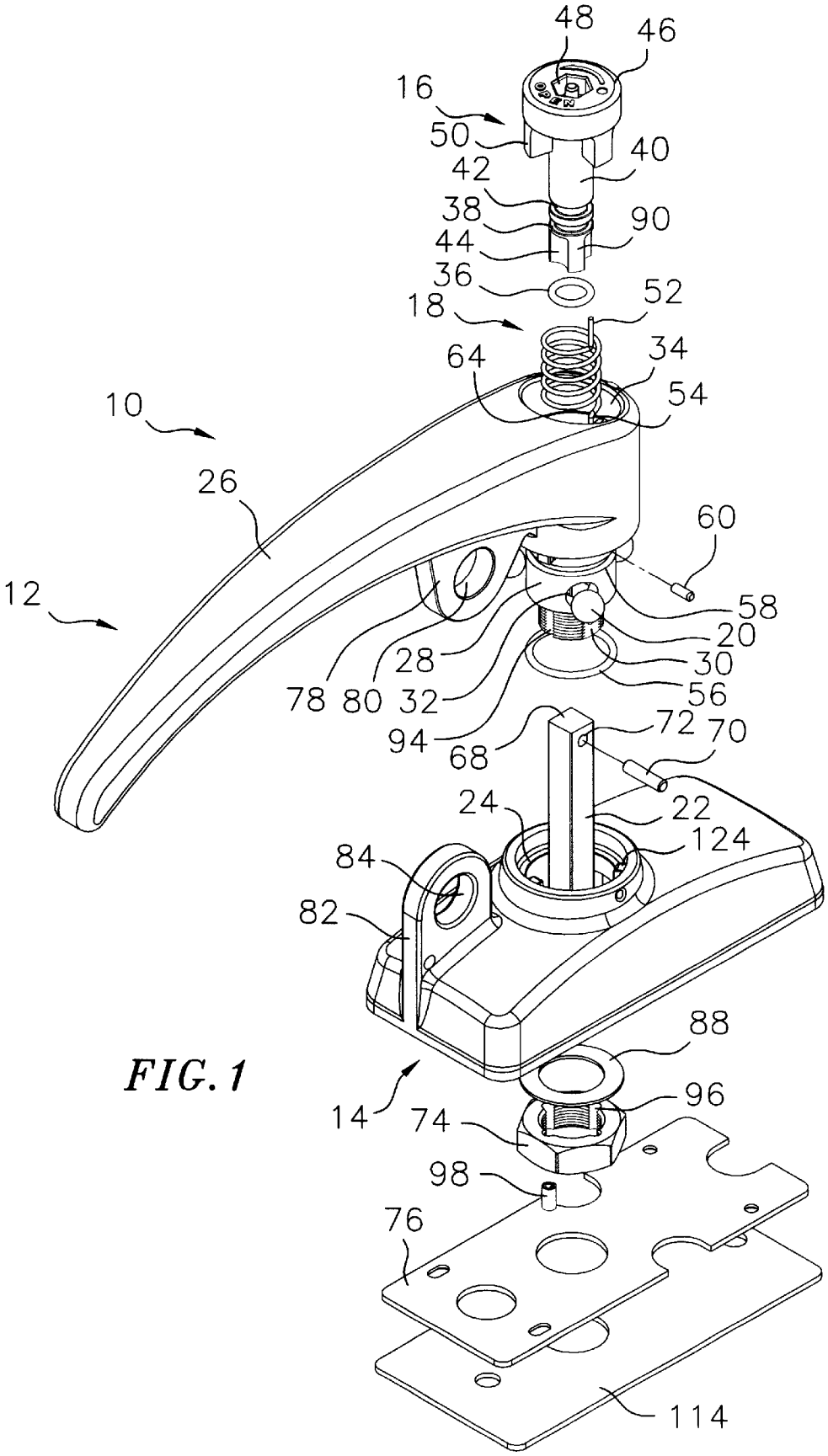
FIG. 1 is an exploded perspective view showing various parts of the L-handle with safety lock feature of an embodiment of the invention.

FIG. 1 is an exploded perspective view showing various parts of the L-handle with safety lock feature 10. The L-handle with safety lock feature 10 has a handle 12 with escutcheon 14, a lock plug 16, a lock shaft 22 which passes through an aperture 24 in escutcheon 14. Handle 12 has a grip portion 26 and a shank 28 with a terminal threaded end 30.

Figure 6:
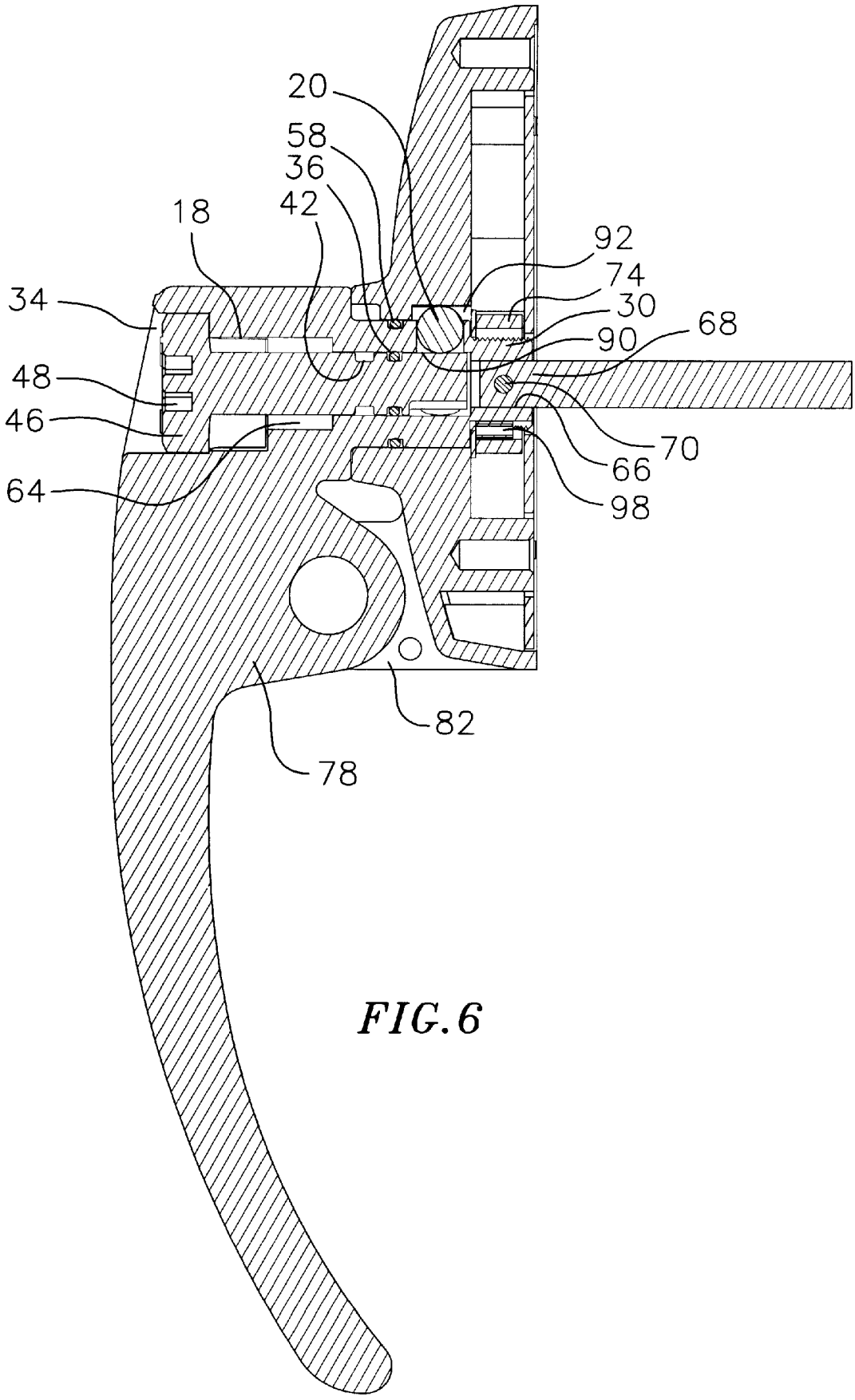
FIG. 6 is a cross-sectional view through view lines 6—6 of FIG. 2.
Figure 7:
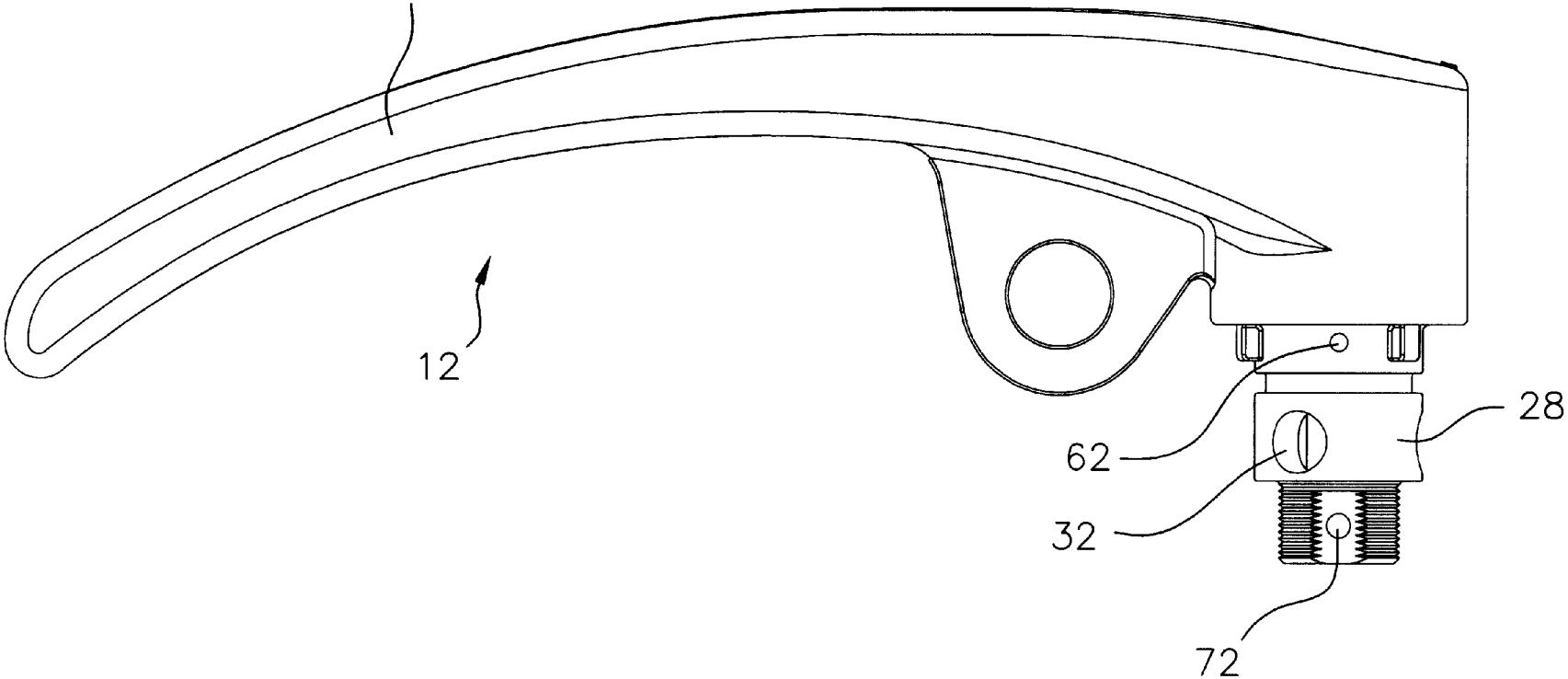
FIG. 7 is a side view of the assembled handle portion of FIG. 5 with the ball bearings removed.

Shank 28 is preferably generally cylindrical and has ball-bearing holes 32 formed therein and passing into a bore 64. Each ball-bearing hole 32 is sized to receive one ball-bearing 20. Handle 12 has a recessed 34 formed co-axially with shank 28 which is sized to rotatably receive lock plug 16. An optioned O-ring washer 36 is positioned in a O-ring groove 38 formed on a shaft 40 of lock plug. A retention groove 42 is also formed on shaft 40. A plurality of recesses, preferably semi-cylindrical recesses 44, are formed near a bottom end of shaft 40. Lock plug 16 has a head 46 with a key contour 48. Plug rotation stops 50 are formed below head 46. Torsion spring 18 has an upper engagement end 52 which catches on lock plug 16 and a lower engagement end 54 which is retained in handle. Torsion spring 18 is sized to fit around shaft 40 of lock plug 16, and when engaged with lock plug 16 and handle 12, will provide a torsional force which will tend to return lock plug 16 to a locked position after being turned to an open position. An O-ring 56 is placed within O-ring groove 58 formed on shank 28. A plug roll pin 60 is press-fit into a plug roll pin aperture 62 formed on handle 12 (as best shown in FIG. 7). Plug roll pin 60, O-ring 36, torsion spring 18 are engaged with handle 12 and inserted into a bore 64 in handle, with retention groove 42 being lined up with plug roll pin aperture 62. Upon inserting plug roll pin 60 therein so that plug roll pin 60 rides in retention groove 42, lock plug will be rotatably retained within handle 12. As best shown in FIG. 6, within terminal threaded end 30, there is formed an opening 66 which is sized to retain an end 68 of lock shaft 22. End 68 of lock shaft can be retained within opening 66 by a shaft roll pin 70 which fits through a shaft roll pin aperture 72 formed on terminal threaded end, as best shown in FIGS. 1 and 6. A body nut 74 and washer 88 fit over terminal threaded end 30 and rotatably retain handle 12 to escutcheon 14. A back plate 76 and a gasket 114 can be placed on the backside of escutcheon. Preferably, handle has a handle padlock clasp 78 formed thereon with an aperture 80 formed therethrough and escutcheon has an escutcheon padlock latch 82 with an aperture 84 formed therein. At lower end of lock plug 16, between semi-cylindrical recesses 44, there are unrecessed portions 90.

Figure 2:
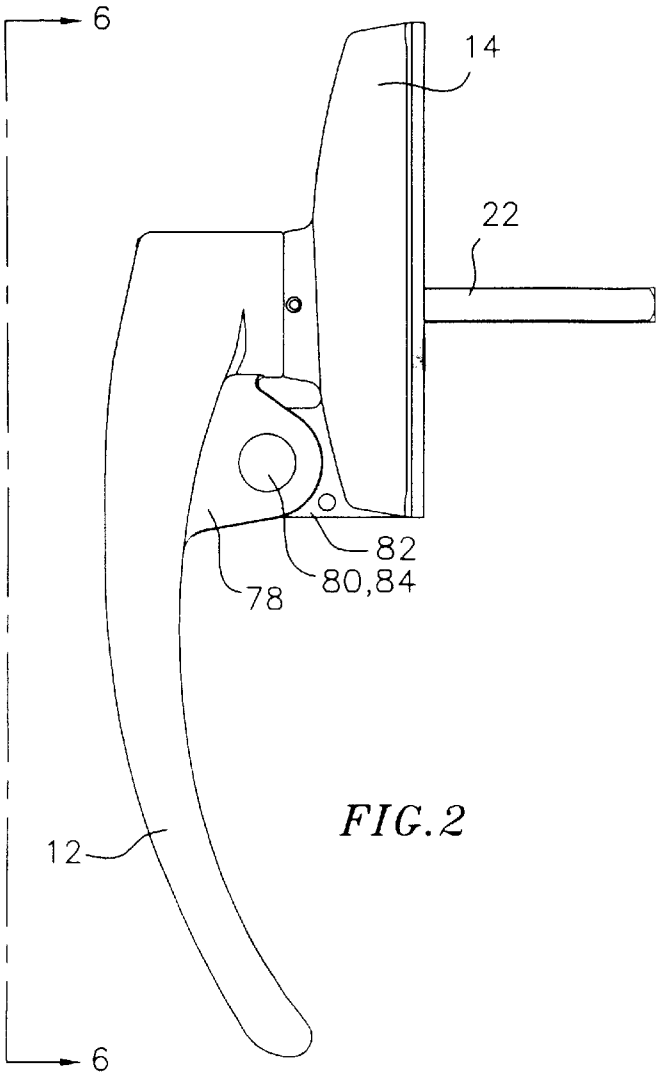
FIG. 2 is a right side view of an assembled L-handle with safety lock feature of FIG. 1.

Turning now to FIG. 2, there is shown a right side view of the assembled L-handle with safety lock feature showing handle 12 engaged with escutcheon 14 with lock shaft extending outwardly with handle padlock latch 78 and escutcheon padlock latch 82 with their aligned apertures 80 and 84 aligned for receipt of a clasp of a padlock (not shown).

Figure 3:
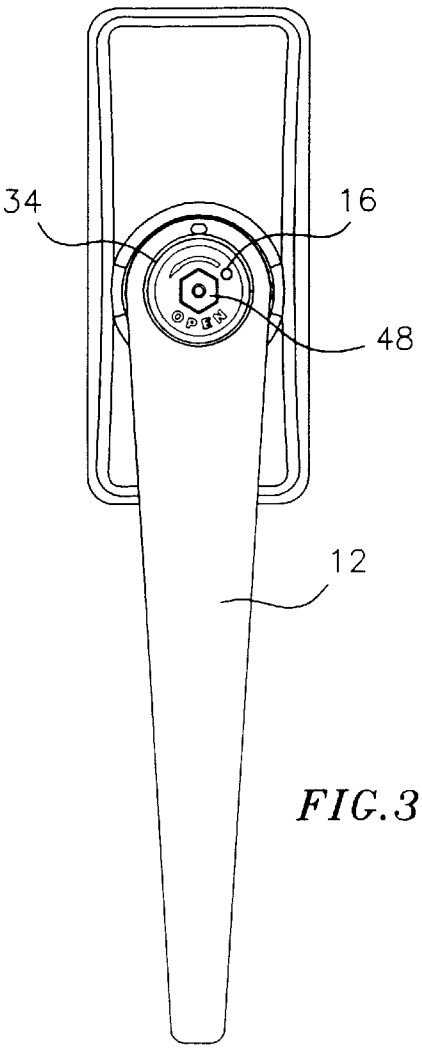
FIG. 3 is a top plan view of the L-handle with safety lock feature of FIG. 2 with the handle and lock plug in their locked positions.

FIG. 3 is a top plan view showing the assembled L-handle with safety lock feature with handle 12 and lock plug 16 in their locked positions and shows lock plug 16 with its key contour 48 in recess 34 of handle 12.

Figure 4:
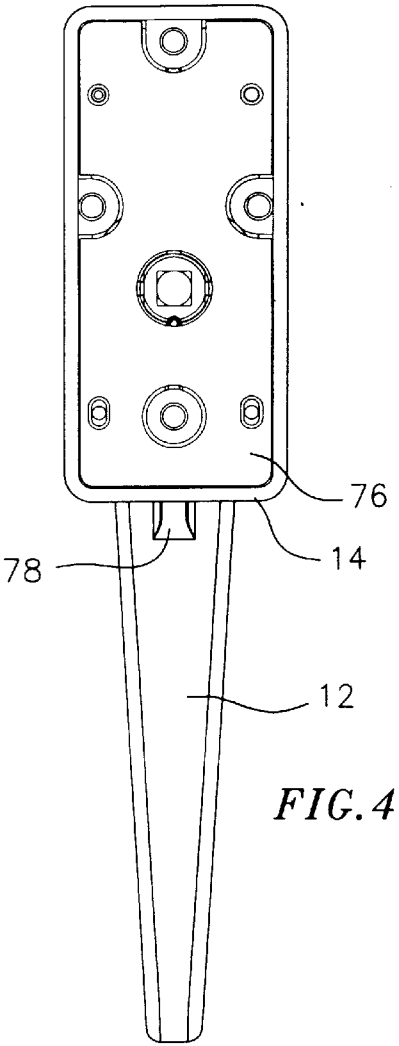
FIG. 4 is a bottom plan view of an assembled L-handle with safety lock feature of FIG. 2.

FIG. 4 shows a back plan view of assembled L-handle with safety lock feature 10 showing back plate 76 placed on a backside of escutcheon 14.

Figure 5:
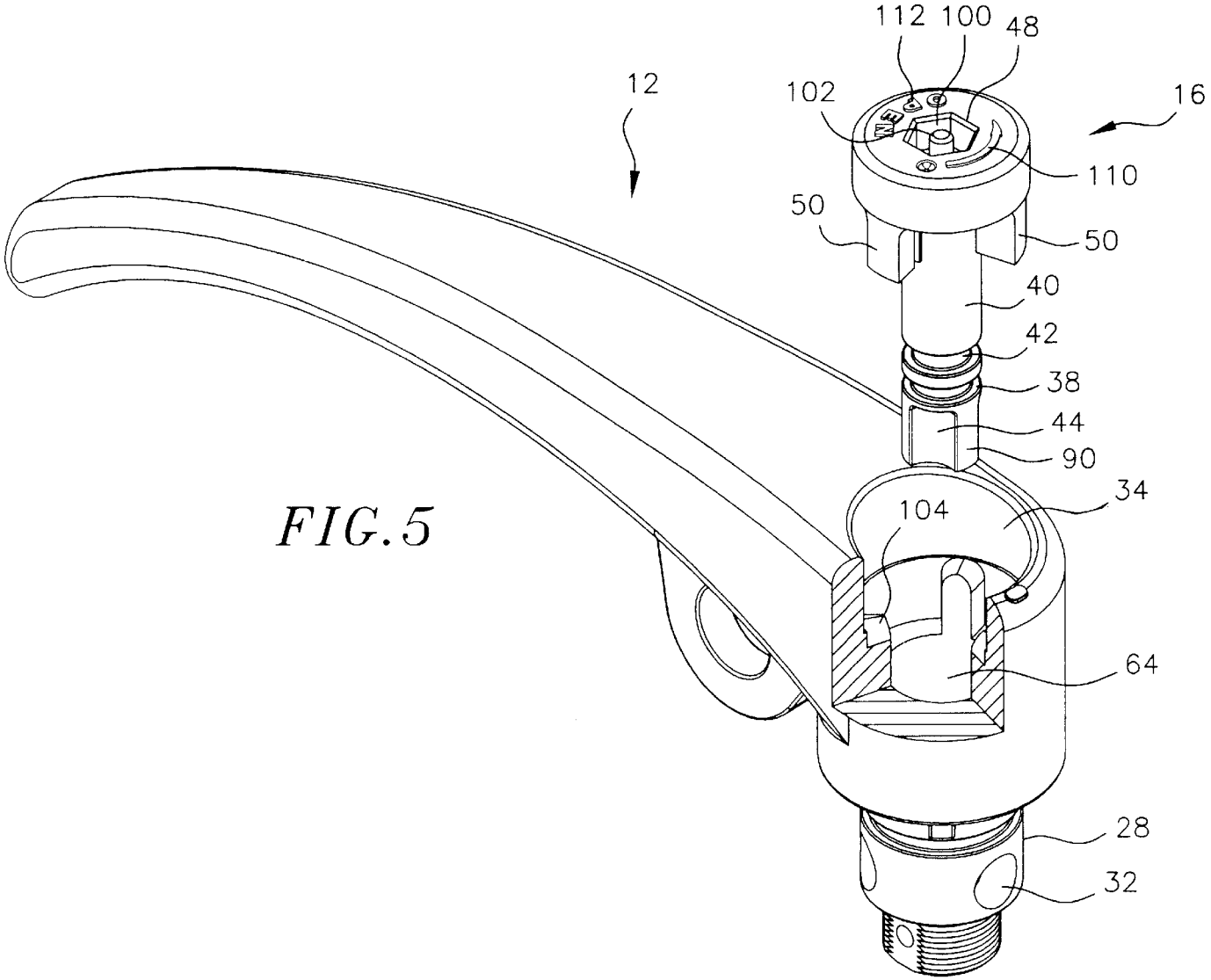
FIG. 5 is an exploded and partially exposed top perspective view of the handle portion and lock plug of FIG. 2.

Turning to FIG. 5, there is shown a partially exposed and exploded view of handle 12 with key plug 16 removed and better showing O-ring groove 38 and retention groove 42 on shaft 40. Also shown are semi-cylindrical recesses 44 and unrecessed areas 90 therebetween at the end of shaft. Plug rotation stops 50 are formed below head 46. Head 46 has a key contour 48, for example, at a hexagonal recess 100 with a protrusion 102 extending therefrom. Recess 34 in handle leads to bore 64 which extends down through shank 28. Inside of recess 34, a plurality of recess stops 104 are formed therein which prevent lock plug 16 from rotating more than a predetermined degree, e.g., ⅓ to ⅙ of a turn, and preferably, just slightly less than ¼ of a turn. A side aperture, or ball-bearing hole 32 is shown in shank 28. A turn indication arrow 110 or other indications and optionally the word "OPEN" 112 can be formed on head 46.

Turning to FIG. 6, there is shown a cross-sectional view through view lines 6—6 of FIG. 2, which shows the L-handle in its locked position. In the locked position 20, ball-bearings 20 ride on unrecessed areas 90 between semi-cylindrical recesses 44(shown in FIG. 5). Escutcheon has bearing pockets 92 formed therein to receive ball-bearings when L-handle is in lock position. Terminal threaded end 30 has a notch 94 formed thereon. Nut 74 has a series of slots 96 formed on its inner threaded surface. When handle is inserted into escutcheon and nut 74 is threaded on to terminal threaded end 30 such as to provide a snug yet turnable fit, one of the slots 96 on nut is lined up with notch 94 on terminal threaded end 30 and a spring pin 98 is inserted to prevent rotation of nut 74 relative to terminal threaded end 30, thereby locking nut 74 onto terminal threaded end 30. Other known means can be used to lock nut 74 onto terminal threaded end 30 in a desired position and free rotation of a nut as handle is turned relative to escutcheon.

Referring to FIG. 7, a side view of the assembled handle portion of FIG. 5 with ball bearings removed is shown. Ball bearing hole 32, plug roll ping aperture 62, and shaft roll pin aperture 72 are shown formed in shank 28.

Figure 8:
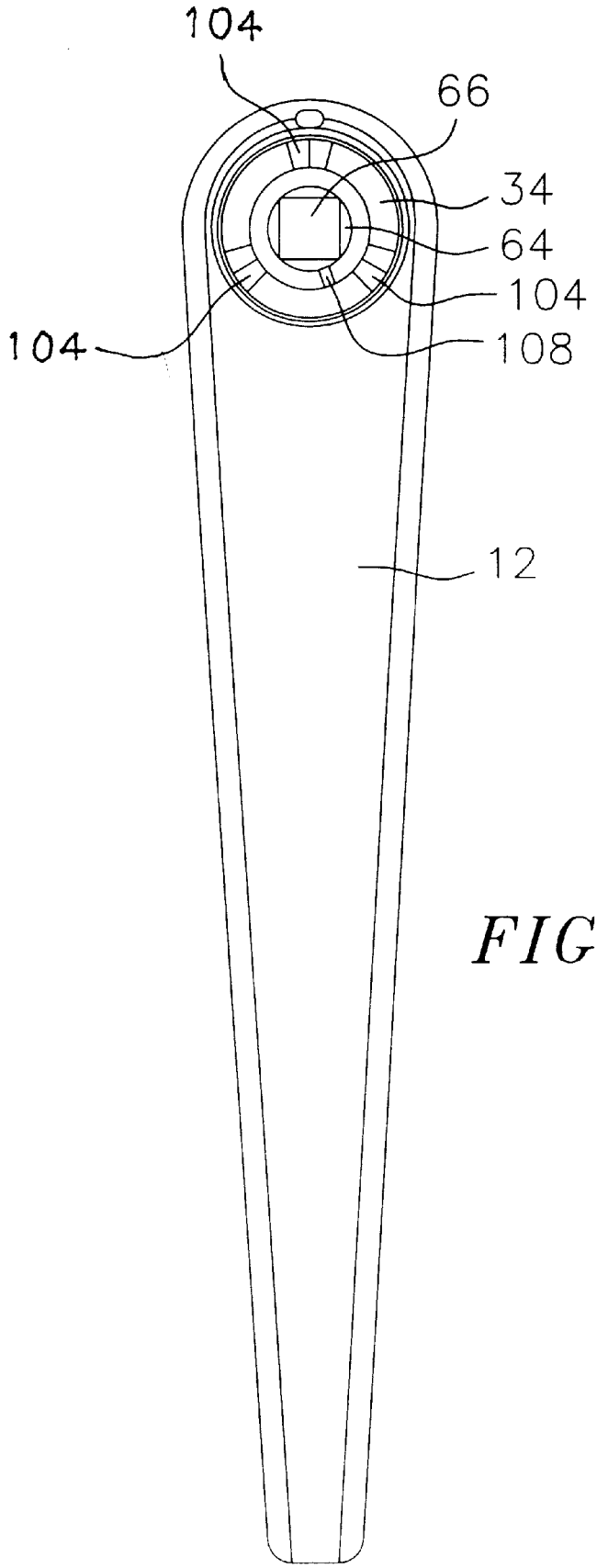
FIG. 8 is a top plan view of the handle portion of FIG. 7 with the lock plug removed.

Turning to FIG. 8, there is shown a top plan view of handle 12. As can be seen, a lower end of bore 64 has a non-round opening (e.g. a square contour) 66 which is matched to receive end 68 of lock shaft 22. Stops 104 are formed inside of recess 34 to impinge on plug rotation stops 50 to limit the degree of rotation of lock plug 16 within bore 34.

Figure 9:
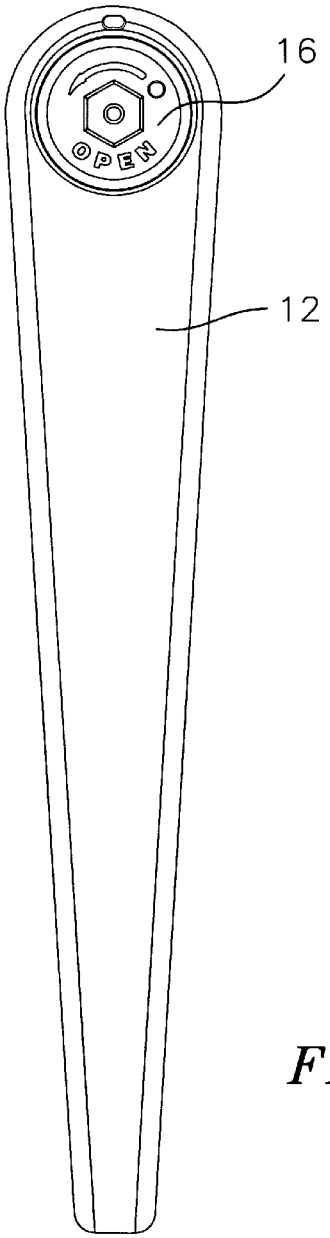
FIG. 9 is a top plan view of the handle portion of FIG. 7 with its lock plug in the lock position.
Figure 10:
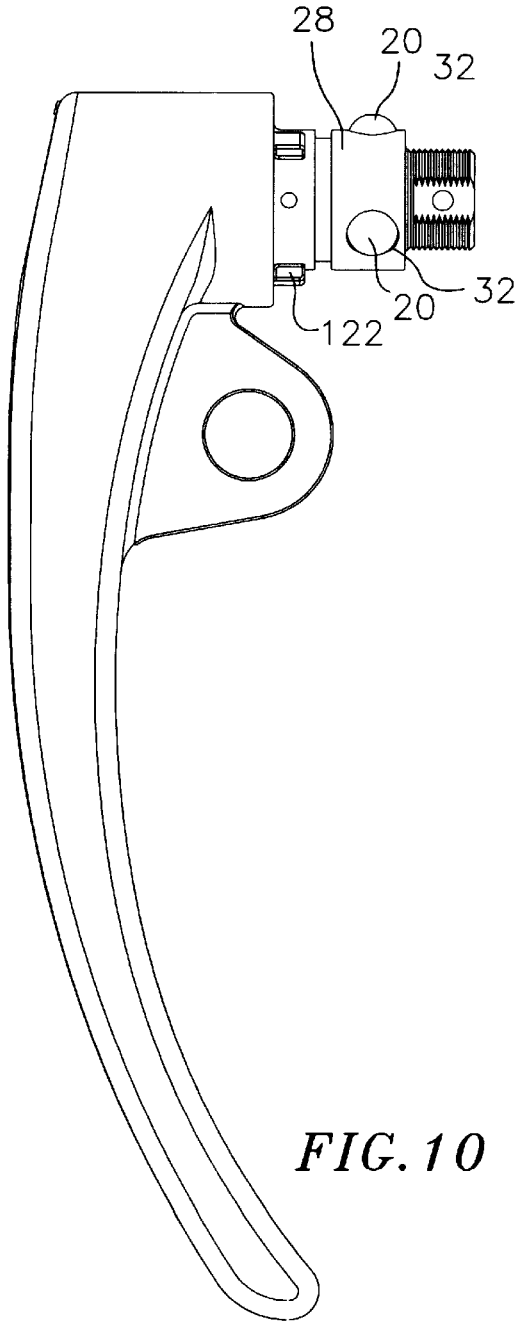
FIG. 10 is a side view of the handle portion of FIG. 7 but with the ball bearings in place and in their protruded position.

Turning to FIGS. 9 and 10, there are shown top plan and side views, respectively, of handle 12 with key plug 16 engaged therewith in a locked position, with ball bearings 20 protruding from ball bearing holes 32 of shank 28.

Figure 11:
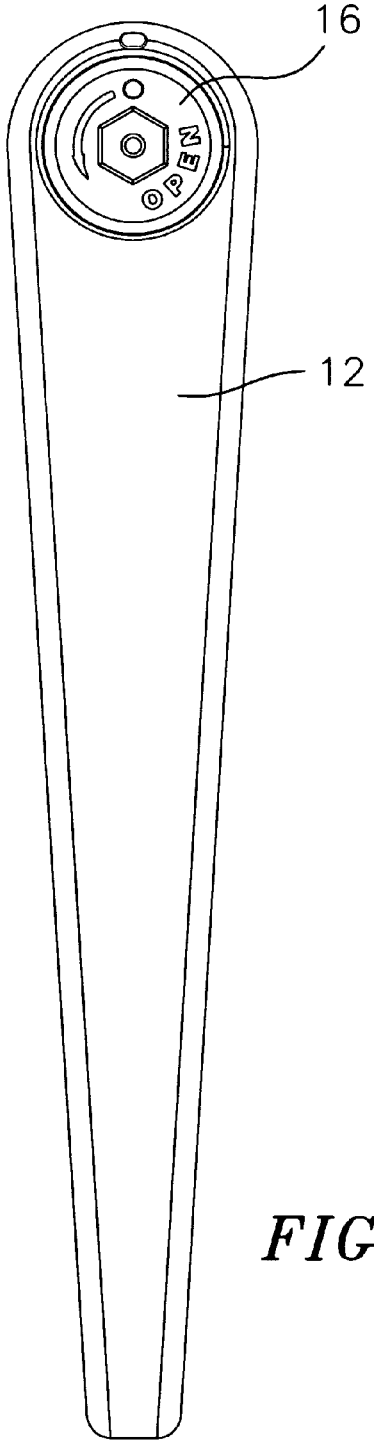
FIG. 11 is a top plan view of the handle portion of FIG. 7 with its lock plug in the unlocked position.
Figure 12:
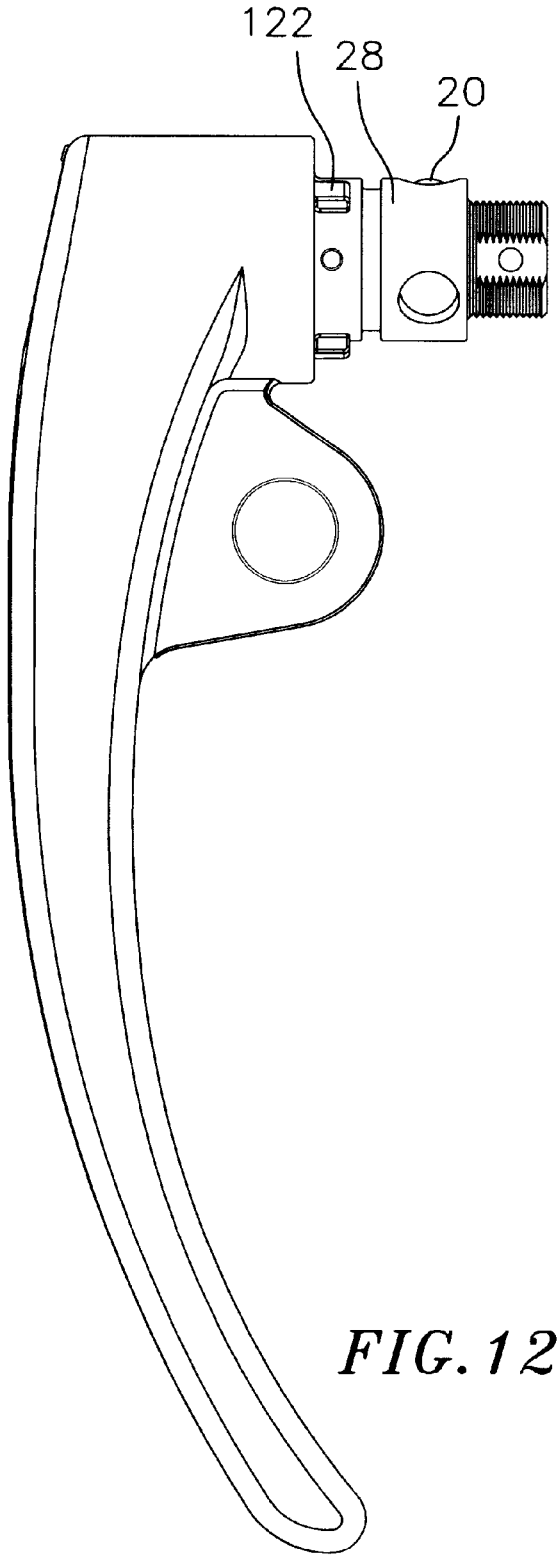
FIG. 12. is a side view of the assembled handle portion of FIG. 7 with ball bearings in place in their retracted position.

Turning to FIGS. 11 and 12, there are shown a top plan view and a side view, respectively, of the handle with key plug inserted therewith but in the open position. In the open position, shaft 40 of key plug 16 is turned such that instead of having the unrecessed areas 90 of shaft being positioned behind ball bearing holes, lock plug 16 is rotated such that semi-cylindrical recesses 44 is positioned behind a ball-bearing hole 32, thereby allowing ball-bearings 20 to drop down so that their level is at or below the level of shank 28, thereby permitting ball-bearing 20 to move out of bearing pockets 92 formed in escutcheon, and thereby permitting handle to be moved relative to escutcheon. However, when handle is moved to its closed position shown in FIG. 3, torsion spring will push bearings 20 back to their extended position shown in FIG. 10, which will be aligned with bearing pockets 92 formed on escutcheon, thereby re-locking handle relative to escutcheon (as best shown in FIG. 6). In this way, the handle can not be accidentally turned without using a key to turn lock plug 16. Handle preferably has handle turn stops 122 formed on its shank, which will prevent handle from being overturned relative to escutcheon, which will have escutcheon turn stops 124 formed within its aperture 24 (as best shown in FIG. 1).

Figure 13:
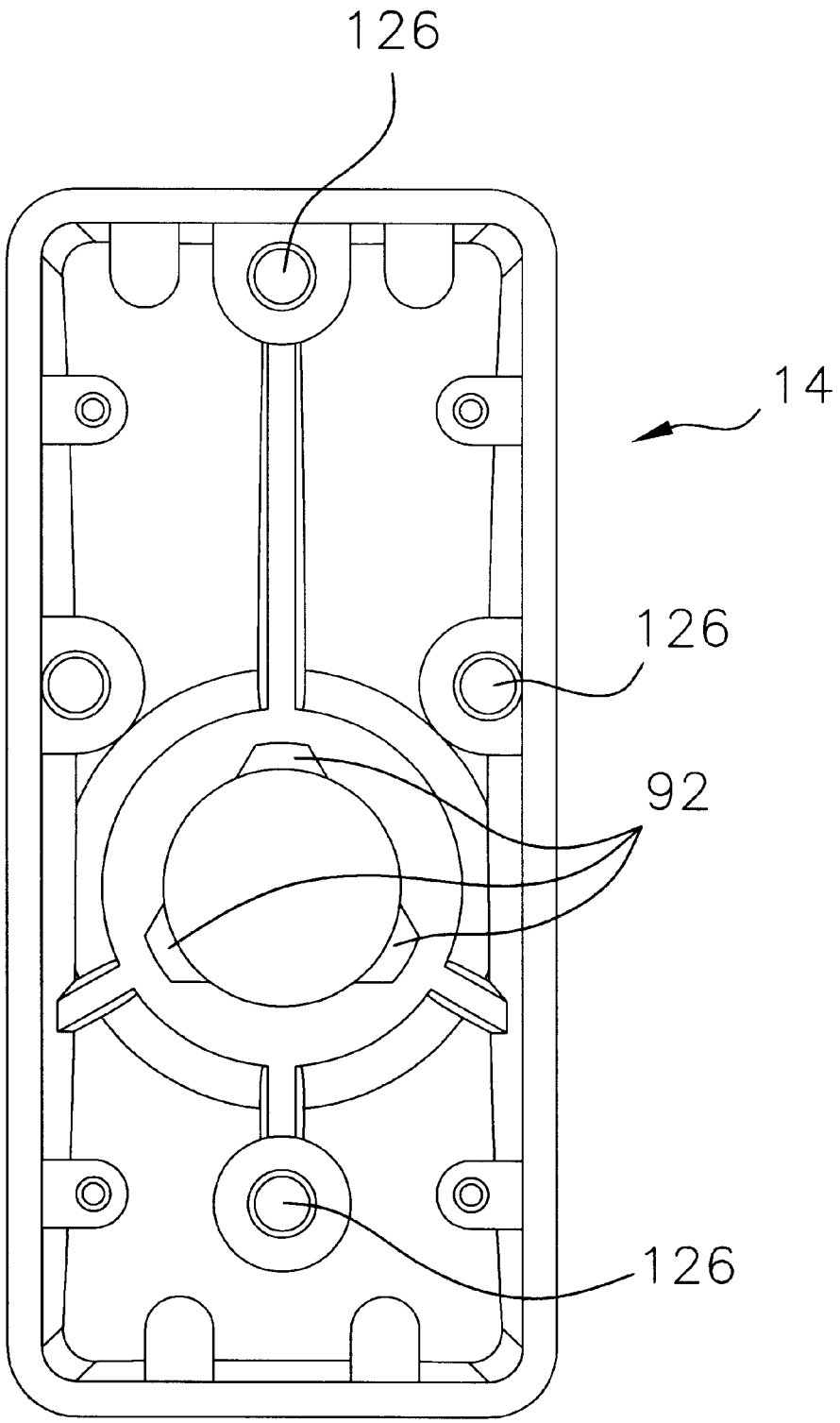
FIG. 13 is a bottom plan view of the escutcheon of the L-handle with safety lock feature of FIG. 1.

Turning to FIG. 13, there is shown a bottom plan view of escutcheon 14 with bearing pockets 92 being shown. Mounting holes 126 are formed on back of escutcheon to permit escutcheon to be securely mounted with screws and bolts to a structure such as a door or door frame (not shown).

Figure 14:
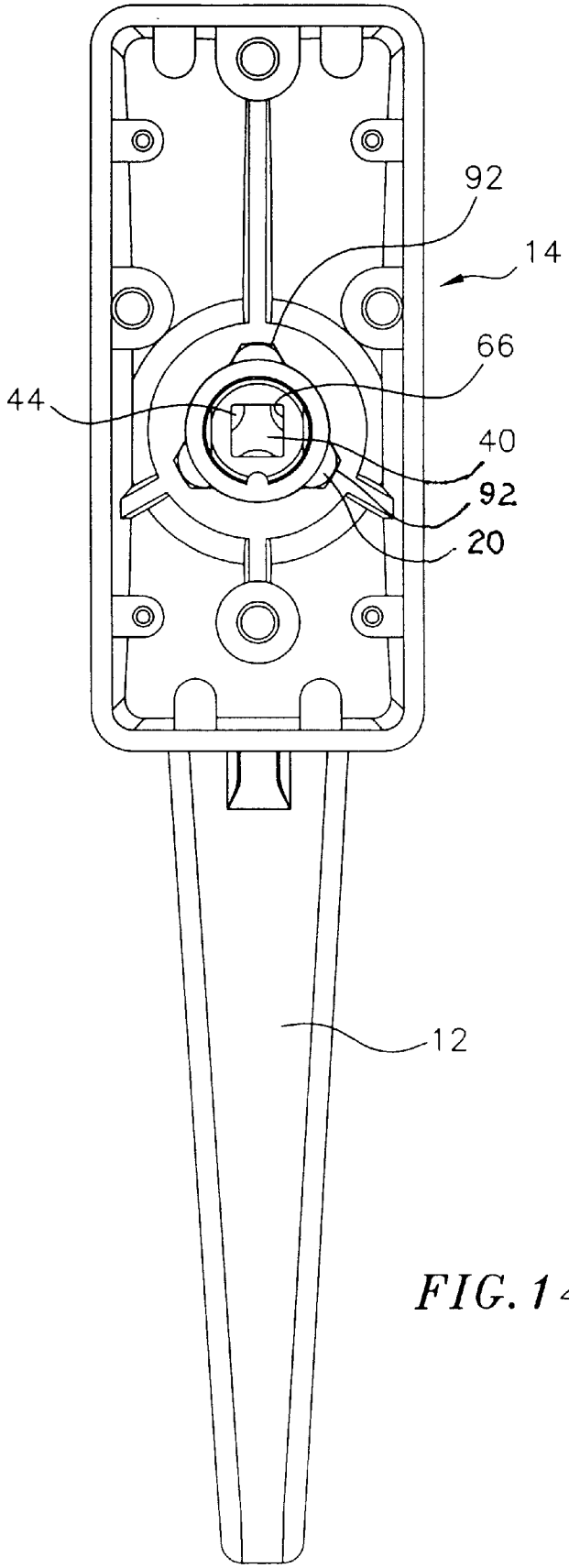
FIG. 14 is a bottom plan view of the assembled lock of FIG. 2 with the handle in its closed position and with the ball bearings in their protruded position engaged with the escutcheon.

Turning to FIG. 14, there is shown a back plan view of the assembled L-handle in its locked position. As can be seen, ball bearings 20 are seated and retained in bearing pockets 92 formed in escutcheon 14, with shaft 22 removed. A portion of the underside of shaft 40 of lock plug 16 can be seen through opening 66 in shank 28, and shows shaft rotated such that semi-cylindrical recesses 44 are out of alignment with bearings 20 and with unrecessed areas 90 (not shown) acting to push bearings 20 into bearing pockets 92. In this locked orientation of lock plug relative to handle, handle 12 can not be rotated relative to escutcheon 14, and handle is prevented from being inadvertently opened.

Figure 15:
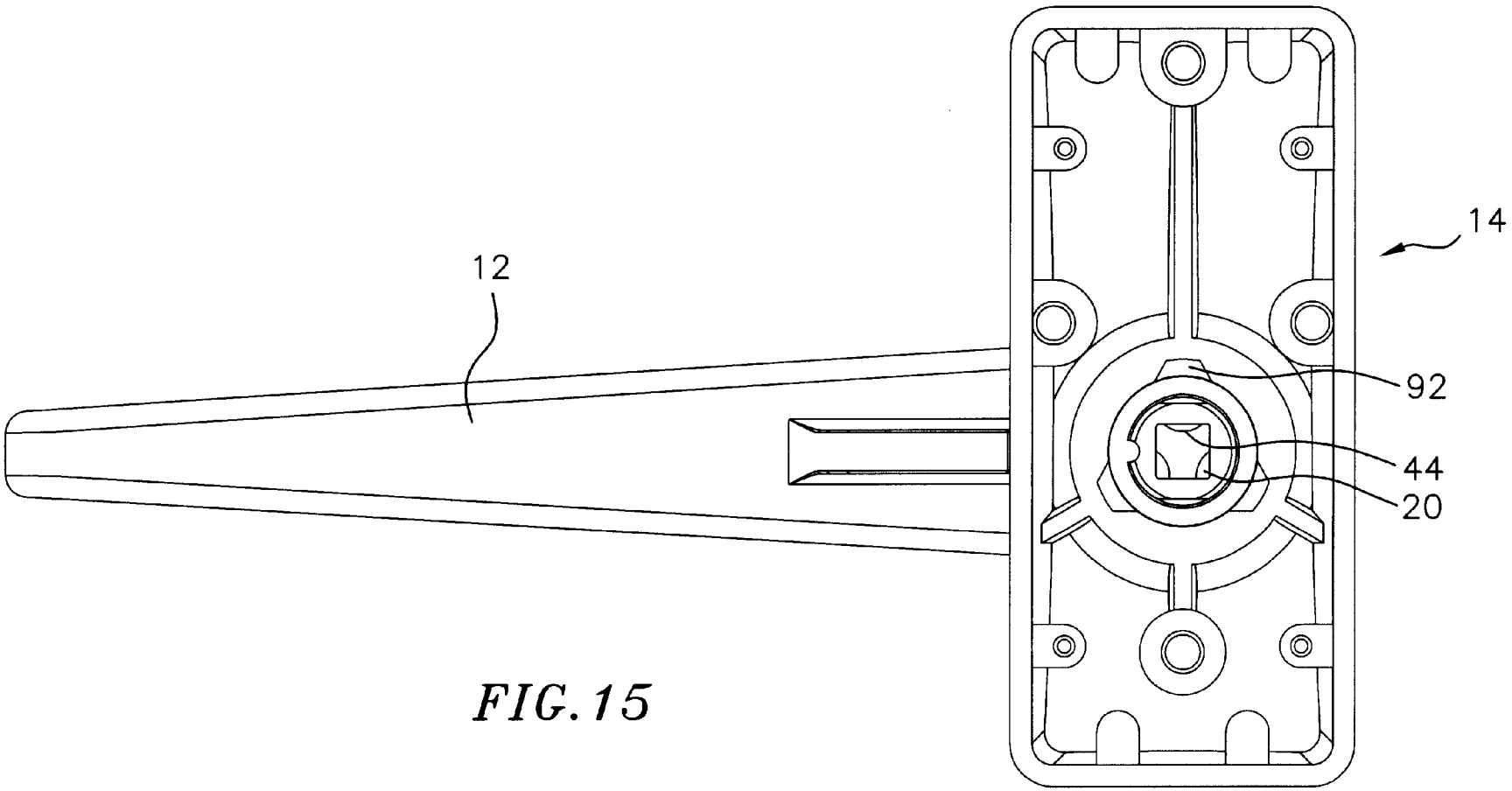
FIG. 15 is a bottom plan view of the assembled lock of FIG. 1 with the handle in its opened position and with the ball bearings in their retracted position disengaged from the escutcheon.

Turning to FIG. 15, there is shown a bottom plan view of a handle lock in its open position, with handle 12 rotated relative to escutcheon 14. As can be seen, in this position, semi-cylindrical recesses 44 are now aligned with ball-bearings 20, and ball-bearings can be moved into recesses and out of bearing pockets 92, and thereby permit handle 12 to be moved relative to escutcheon 14.

Although the preferred embodiment is shown with three ball-bearings used, other objects can be used in lieu of ball-bearings, including cylindrical objects, or even non-cylindrical objects. One advantage of using objects having rounded surface, such as cylindrical bearings and more preferably ball-bearings, is that they can be easily moved in and out of pockets and freely rotated, and are readily available and made of high quality, corrosion-resistant materials. Also, ball-bearings are adapted to easily moved through cylindrical ball-bearing holes 32 formed in shaft 28, which ball-bearing holes 32 can be readily machined. Also, the spherical shape of ball-bearings is allowed to move around within the lock and thereby prevent excessive wear on one surface of the ball-bearing. The objects can have a cylindrical shape with semi-cylindrical ends. Also, while three ball-bearings are shown, the device would work adequately with at least one bearing, although two to three and more spreads the force more evenly and insure a smooth operation. In assembly, readily available lubricants are preferably used to insure smooth operation. Assembly of the unit is readily being snapped into place, bearings dropped in, and the two roll pins 60 and 70 being easily used. As such, the L-handle 10 of the invention is easy to assemble, yet strong and reliable.

Moreover, since the safety lock mechanism is more or less contained within handle and aperture of the escutcheon, rather than in a main body area of the escutcheon where it is more possibly exposed to elements, the smooth operation of the safety locking feature can be insured. Furthermore, if repairs are required, due to the simple construction and design, any necessary repairs can readily be made.

The drawings in the foregoing description are not intended to represent the only form of the invention in regard to the details of its construction and manner of operation. In fact, it will be evident to one skilled in the art that modifications and variations can be made without departing from the spirit and scope of the invention. Although specific terms have been employed, they are intended in a generic and descriptive sense only and not for purposes of limitation.

What is claimed is:

1. A latch with a safety lock feature, comprising:

a handle with a grip portion and a shank portion, the shank portion having a bore formed axially therethrough, with at least one side aperture extending through the shank portion into communication with the bore;

an interposing object sized to be placed in the side aperture;

a lock plug positioned in the bore of the handle, the lock plug having a head portion and a shaft portion, the shaft having a recessed portion and an unrecessed portion, the lock plug being rotatable to move the lock plug between a locked position, wherein the unrecessed portion is in alignment with the side aperture to cause the interposing object to protrude from the side aperture, and an unlocked position, wherein the unrecessed portion is in alignment with the side aperture permitting the interposing object to retract into the side aperture;

a biasing means which biases the lock plug to its locked position;

an escutcheon with an aperture for receiving the shank portion of the handle, the aperture having a pocket for the interposing means, wherein when the handle is in a closed position and the lock plug is in the locked position, the unrecessed portion of the shaft is aligned with the side aperture which is in alignment with the pocket, thereby preventing turning of the handle, and when the lock plug is in the unlocked position, the recessed portion of the shaft is aligned with the side aperture and the interposing object can retract from the pocket, thereby permitting the handle to be turned and opened.

2. The latch with a safety lock feature of claim 1, wherein the lock plug has plug rotation stops and the handle has recess stops, the plug rotation stops and the recess stops preventing the lock plug from being rotated more than a predetermined degree of rotation relative to the handle.

3. The latch with a safety lock feature of claim 1, wherein the lock plug has a keyed head portion that requires a special tool for turning.

4. The latch with a safety lock feature of claim 1, wherein the interposing object is a ball bearing.

5. The latch with a safety lock feature of claim 1, wherein the biasing means is a torsion spring.

6. The latch with a safety lock feature of claim 1, further comprising handle turn stops on the handle and escutcheon turn stops in the aperture of the escutcheon for limited the degree of rotation of the handle in the escutcheon.

7. The latch with a safety lock feature of claim 1, wherein the shaft of the lock plug has a retention groove formed thereon and the shank portion of the handle has a pin which extends into the shaft bore and rides in the retention groove to permit rotation of lock plug in bore but prevents axial withdrawal of lock plug from bore.

8. The latch with a safety lock feature of claim 1, wherein there are a plurality of interposing objects, and an equal plurality of side apertures, recessed and unrecessed portions of lock plug shaft, and pockets.

9. The latch with a safety lock feature of claim 1, wherein the grip portion is elongate and has a handle padlock latch with an aperture formed thereon, and the escutcheon has an escutcheon padlock latch with an aperture formed thereon, the handle padlock latch and the escutcheon padlock latch lining up with their apertures aligned when the handle is in the closed position.

10. The latch with a safety lock feature of claim 1, wherein the handle shank has a terminal threaded end, and a nut is provided for screwing onto the terminal threaded end to rotatably retain the handle on the escutcheon.

11. The latch with a safety lock feature of claim 10, further comprising means to retain the nut in a desired position on the terminal threaded end.

12. The latch with a safety lock feature of claim 1, further comprising a lock shaft fitted to the handle shaft.

13. The latch with a safety lock feature of claim 1, wherein the bore in the handle shank portion is enlarged at an upper end exiting the handle and the head of the lock plug is sized to seat in the enlarged upper end.

14. The latch with a safety lock feature of claim 1, further comprising washers placed on the shaft of the lock plug and shank of the handle.

15. The latch with a safety lock feature of claim 1, further comprising a cover for a back of the escutcheon.

16. A latch with a safety lock feature, comprising:

a handle having a shank portion with a bore formed therethrough, with a side aperture extending through the shank portion into communication with the bore;

an interposing object placed in the side aperture;

a lock plug positioned in the bore of the shank portion, the lock plug having a keyed head portion and a shaft, the keyed head portion, the shaft having a radially spaced apart recessed area and unrecessed area, the lock plug being rotatable to move the lock plug between a locked position, wherein the unrecessed area is in alignment with the side aperture to cause the interposing object to protrude from the side aperture, and an unlocked position, wherein the unrecessed area is in alignment with the side aperture to permit the interposing object to retract into the side aperture;

a biasing means which biases the lock plug to the locked position when the keyed head is not being turned to move the lock plug to its unlocked position;

an escutcheon with an aperture for receiving the shank portion of the handle, the aperture having a pocket for the interposing means, wherein when the handle is in a closed position and the lock plug is in the locked position, the unrecessed portion of the shaft is aligned with the side aperture which is in alignment with the pocket, thereby preventing turning of the handle, and when the lock plug is in the unlocked position, the recessed portion of the shaft is aligned with the side aperture and the interposing object can retract from the pocket, thereby permitting the handle to be turned and opened.

17. The latch with a safety lock feature of claim 16, wherein the interposing object is a ball bearing.

18. The latch with a safety lock feature of claim 16, wherein the biasing means is a torsion spring.

19. The latch with a safety lock feature of claim 16, wherein the shaft of the lock plug has a retention groove formed thereon and the shank portion of the handle has a pin which extends into the shaft bore and rides in the retention groove to permit rotation of lock plug in bore but prevents axial withdrawal of lock plug from bore.

20. The latch with a safety lock feature of claim 16, wherein there are a plurality of interposing objects, and an equal plurality of side apertures, recessed and unrecessed portions of lock plug shaft, and pockets.

21. The latch with a safety lock feature of claim 16, wherein the handle shank has a terminal threaded end, and a nut is provided for screwing onto the terminal threaded end to rotatably retain the handle on the escutcheon.

22. The latch with a safety lock feature of claim 21, further comprising means to retain the nut in a desired position on the terminal threaded end.

23. The latch with a safety lock feature of claim 16, further comprising a lock shaft fitted to the handle shaft.

* * * * *